United States Patent [19]

Tano et al.

[11] Patent Number: 4,753,051

[45] Date of Patent: Jun. 28, 1988

[54] APPARATUS FOR PROCESSING WORKPIECE WITH SANDBLASTING

[75] Inventors: Teruo Tano, Ohta; Shuji Hamada, Yokohama, both of Japan

[73] Assignee: Niigata Engineering Co., Ltd., Tokyo, Japan

[21] Appl. No.: 876,890

[22] PCT Filed: Nov. 6, 1985

[86] PCT No.: PCT/JP85/00615

§ 371 Date: Jun. 10, 1986

§ 102(e) Date: Jun. 10, 1986

[87] PCT Pub. No.: WO86/02870

PCT Pub. Date: May 22, 1986

[30] Foreign Application Priority Data

Nov. 6, 1984 [JP] Japan ..... 59-233675

[51] Int. Cl.[4] ..... B24C 3/22; B24C 3/32

[52] U.S. Cl. ..... 51/421; 51/425; 51/426

[58] Field of Search ..... 51/410, 419, 421, 424, 51/425, 426, 438, 436, 319, 320, 321, 322, 413, 283 E

[56] References Cited

U.S. PATENT DOCUMENTS

| | | | |
|---|---|---|---|
| 2,454,158 | 11/1948 | Gossard | 51/421 |
| 2,628,456 | 2/1953 | Berg | 51/424 |
| 3,192,677 | 7/1965 | Johnson et al. | 51/424 X |
| 3,685,208 | 8/1972 | Richter | 51/410 X |
| 3,903,526 | 9/1975 | Cotter | 51/410 X |
| 4,375,740 | 3/1983 | Brown | 51/425 |

FOREIGN PATENT DOCUMENTS

| | | | |
|---|---|---|---|
| 557181 | 5/1958 | Canada | 51/425 |
| 918068 | 4/1982 | U.S.S.R. | 51/319 |

*Primary Examiner*—Robert P. Olszewski

*Attorney, Agent, or Firm*—Kane, Dalsimer, Sullivan, Kurucz, Levy, Eisele and Richard

[57] ABSTRACT

There is disclosed a method of and an apparatus for performing, using a sandblasting, a processing such as a chamfering of a workpiece which has a surface to be processed and a surface not to be processed located adjacent to each other. The workpiece (W) held by a holder (2) on a turntable (1) is transferred to a processing station ($P_1$) by the rotation of the turntable (1). An injection nozzle (3) or (4) is directed toward the surface to be processed ($f_1$) of the workpiece (W), while a jet nozzle (5) is directed toward the surface not to be processed ($f_2$). The jet nozzle (5) is supplied with fluid such as air, and the nozzle (3) or (4) is supplied with air containing abrasive grains. The fluid discharged from the jet nozzle (5) prevents the abrasive grains from impinging against the surface not to be processed ($f_2$).

8 Claims, 3 Drawing Sheets

APPARATUS FOR PROCESSING WORKPIECE WITH SANDBLASTING

FIELD OF THE INVENTION

This invention relates to a processing method of and its apparatus for processing, utilizing a sandblasting, a workpiece which has a surface not to be processed adjacent a surface to be processed.

BACKGROUND ART

A chamfering of an end edge Wa of a relatively small workpiece W, such as one shown in FIG. 1, and a peripheral edge Wc of a bore Wb therein, has conventionally been performed by a hand process, utilizing a thread-like abrasive tape. However, such method has disadvantages in that it is troublesome, time-consuming and inefficient.

As an automated method of such a processing, a processing method utilizing a sandblasting is proposed in which abrasive grains comprised of, for example, silica sand, chilled cast iron or the like are caused to strongly impinge against a workpiece surface to be processed. However, as in the case of a head for a video signal recording and reproducing apparatus, for example, in which the workpiece W has a $f_2$ requiring a mirror finish adjacent surfaces $f_1$ to be processed by the sandblasting, there would be a fear that the abrasive grains of the sandblasting impinge also against the surface $f_2$ to exert a bad influence thereupon. For this reason, as matters stand, the conventionally general technology does not allow the sandblasting to be adopted for processing of the workpiece W.

Accordingly, an object of the present invention is to provide a processing method which can process, utilizing a sandblasting, a workpiece which has a surface not to be processed adjacent a surface to be processed.

Another object of the present invention is to provide an apparatus utilizing such processing method.

SUMMARY OF THE INVENTION

According to this invention, there is provided a method of processing a workpiece wherein, while blowing fluid against a first portion of the workpiece, abrasive grains are caused to impinge against a second portion of the workpiece, to process only the second portion by the abrasive grains while preventing the abrasive grains from impinging against the first portion by the fluid.

In addition, according to this invention, there is provided a processing apparatus comprising abrasive grain supply means for supplying pressurized fluid containing abrasive grains, fluid supply means for supplying pressurized fluid, a first nozzle for blowing the pressurized fluid against a first portion of a workpiece, and a second nozzle for flowing the pressurized fluid containing the abrasive grains against a second portion of the workpiece.

Furthermore, according to this invention, there is provided a processing apparatus further comprising a vacuum generating means and a suction port connected to the vacuum generating means and opening adjacent the first and second nozzles, so that the injected abrasive grains are drawn.

Moreover, according to this invention, there is provided a processing apparatus characterized in that a collecting means is provided between the suction port and the vacuum generating means for collecting the drawn abrasive grains.

Furthermore, according to this invention, there is provided a processing apparatus wherein the abrasive grains collected by the collecting means are supplied to the abrasive grain supply means so that the abrasive grains are recirculated.

Furthermore, according to this invention, there is provided a processing apparatus wherein a bypass passage capable of being opened and closed is provided between a first abrasive grain path disposed between the abrasive grain supply means and the second nozzle, and a second abrasive grain path disposed between the suction port and the vacuum generating means.

In addition, according to this invention, there is provided a processing apparatus wherein a first valve disposed at a side of the first abrasive grain path downstream of the bypass passage, a second valve for opening and closing the bypass passage, and control means for controlling the opening and closing of the first and second valve are provided, the control means opening the first valve and closing the second valve when the workpiece is processed, and in the case other than this, closing the first valve and opening the second valve.

BEST MODE FOR CARRYING OUT THE INVENTION

Figure 1:
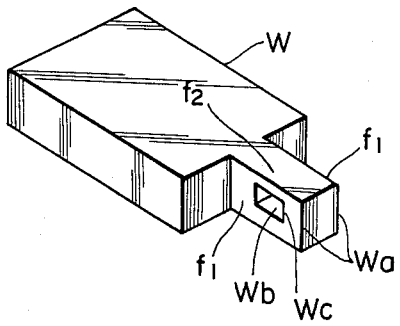
FIG. 1 is a perspective view showing an example of a workpiece.
Figure 3:
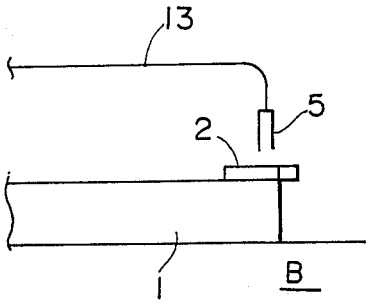
FIG. 3 is a side elevational view of a portion of the apparatus of FIG. 2, illustrating a positional relationship between a rotary table 1 and a jet nozzle 5.
Figure 4:
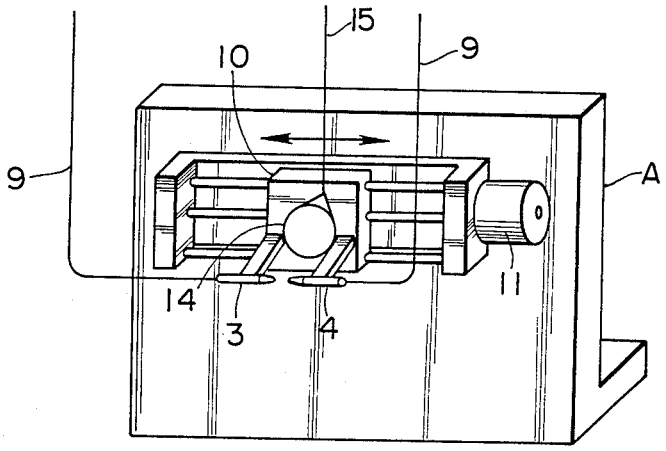
FIG. 4 is a perspective view showing a support structure for injection nozzles 3 and 4 in the apparatus of FIG. 2.
Figure 2:
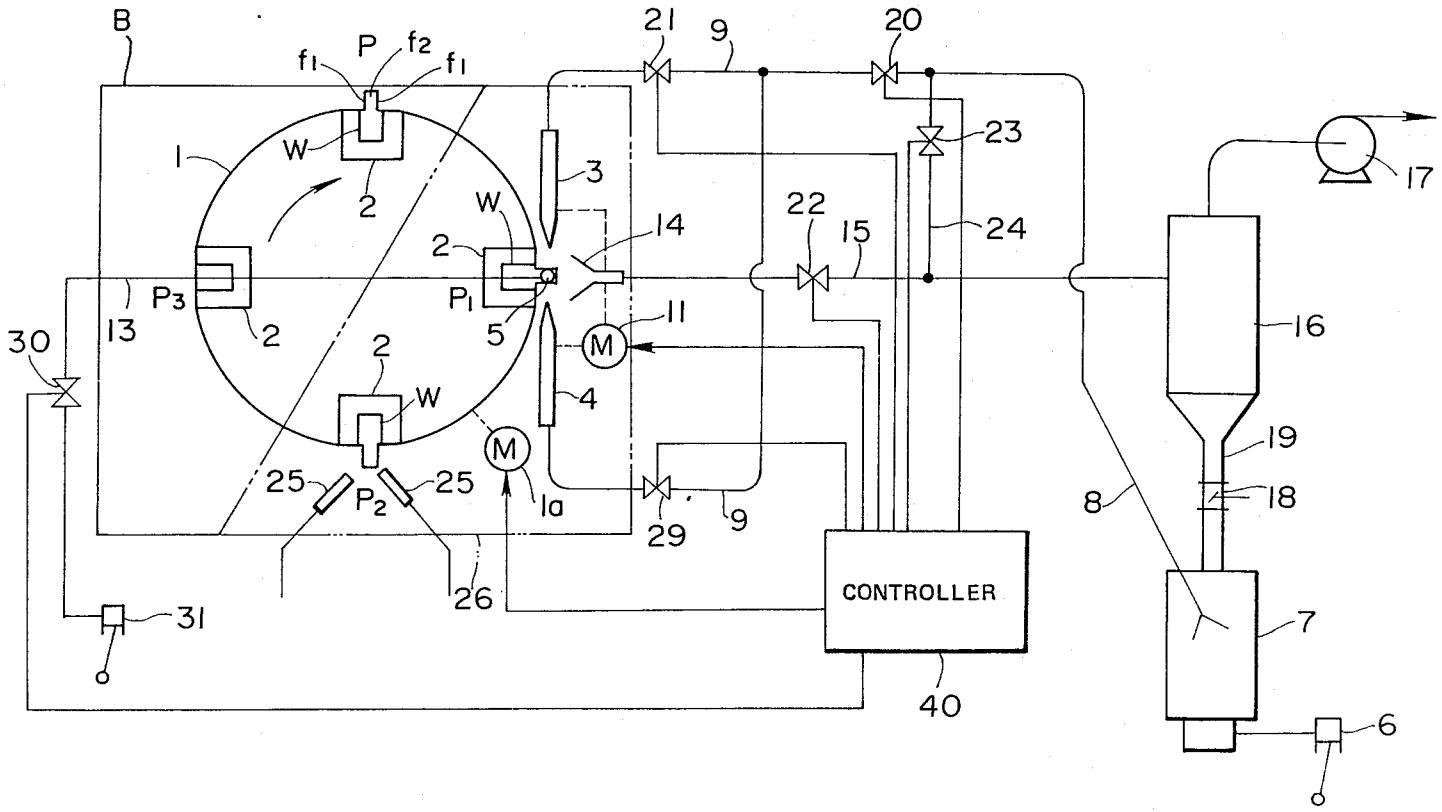
FIG. 2 is a schematic view showing an arrangement of a processing apparatus in accordance with this invention.

FIGS. 2 and 3 show an example of a basic structure of a processing apparatus in accordance with the present invention. In FIGS. 2 and 3, B is a base on which a rotary table 1 is disposed. An outer peripheral portion of the rotary table 1 is provided with four holders 2 equidistantly spaced from each other wherein objects W (as a matter of convenience, the object shown in FIG. 1 is regarded as a workpiece) can be respectively held by the holders 2 and be intermittently transferred one by one to a processing station $P_1$. In this case, the rotary table 1 is driven by a motor 1*a* and is stopped by means of a limit switch or the like not shown, when the table is rotated to a predetermined position. The above-described processing station $P_1$ has disposed thereat two injection nozzles 3 and 4 and a single jet nozzle 5. The injection nozzles 3 and 4 are provided for strongly blasting abrasive grains delivered from a tank 7 through pipes 8 and 9 by compressed air provided by an operation of an air compressor 6, against the surface to be processed $f_1$ of the object W. Since, in case of the object W shown in FIG. 1, the surfaces to be processed $f_1$ are two in back to back relation, the nozzles 3 and 4 are mounted on a slider 10, as shown in FIG. 4, in such a manner that tips of the respective nozzles face toward each other. The arrangement is such that the nozzles 3 and 4 are axially moved by the movement of the slider 10 by a motor 11 in such a manner that when one of the injection nozzles 3 moves perpendicularly toward one of the surfaces to be processed $f_1$ of the object W at the processing station $P_1$, the other injection nozzle 4 moves away from the other surface to be processed $f_1$, and, when the injection nozzle 4 moves toward the surface to be processed $f_1$ facing thereto, the other injection nozzle 3 moves away from the other surface to be processed $f_1$.

As shown in FIG. 4, the slider 10 is supported by the base B, for example, through a supporting member A.

The jet nozzle 5 is provided for strongly blowing exclusion fluid such as air for excluding the abrasive grains, against the surface not to be processed $f_2$ of the object W. Since the surface not to be processed $f_2$ is formed by an upper surface of the object W, the nozzle 5 is disposed above the rotary table 1, as shown in FIG. 2, so as to extend perpendicularly to the surface not to be processed $f_2$ of the object W at the processing station $P_1$, and the nozzle 5 is connected to a supply source 31 of the exclusion fluid through a pipe 13 and a valve 30.

In addition to the two nozzles 3 and 4, the slider 10 has thereon a suction unit 14 which is in communication with a dust collection device 16 through a pipe 15. The dust collecting device 16 draws the abrasive grains having processed the object W and dust generated upon the processing, through the suction unit 14, to separate the abrasive grains from the dust, to thereby purify the air which is discharged to the atmosphere by a blower 17. The dust collecting device 16 is connected to the tank 7 through a communication duct 19 having provided therein a damper 18 so as to be able to return the recovered abrasive grains to the tank 7. The above-described pipes 8, 9 and 15 have respectively provided therein valves 20, 21 and 22, and the pipe 8 and the pipe 15 are connected to each other by a bypass tube 24 having provided therein a valve 23, at the side of the above-described valve 20 adjacent the tank 7 and at the side of the valve 22 adjacent the dust collecting device 16. Accordingly, with this arrangement, the abrasive grains are injected from the two injection nozzles 3 and 4 by the simultaneous opening of the valve 20 and the two valves 21 and 29, the abrasive grains are injected against the surface to be processed $f_1$ from any one of the injection nozzles 3 and 4 by the opening of only one of the two valves 21 and 29 to enable the processing, and during the interruption of the processing, the closing of the valve 20 and the opening of the valve 23 allow the abrasive grains to be recirculated in the order of the tank 7—pipe 8—bypass tube 24—pipe 15—dust collecting device 16—communication duct 19—tank 7, to maintain the abrasive grains in a fluent condition, so that it is possible to stably supply the abrasive grains to the injection nozzles 3 and 4, rapidly simultaneously with the start of the processing.

Figure 5:
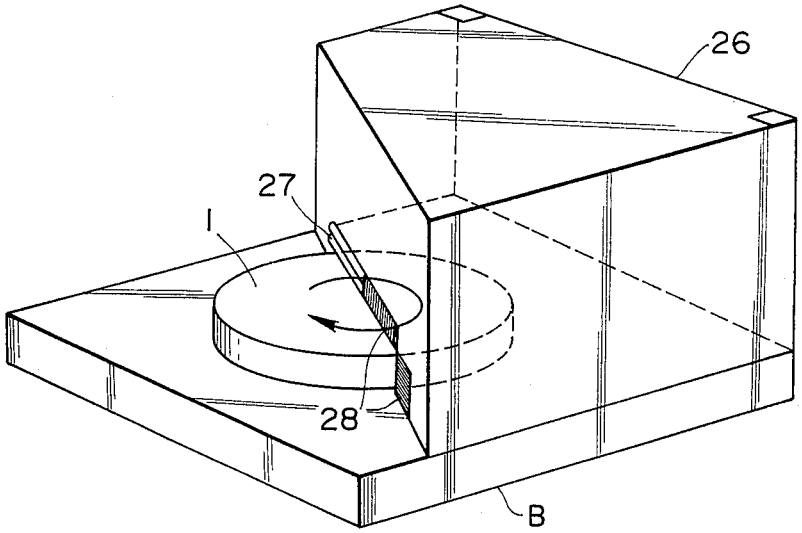
FIG. 5 is a perspective view of the apparatus of FIG. 2.
Figure 6:
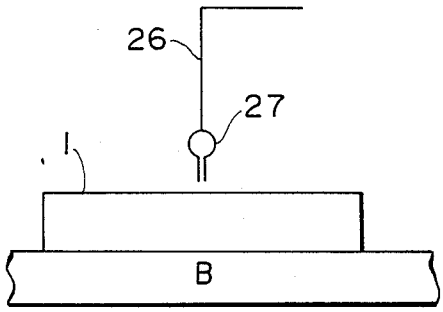
FIG. 6 is a cross-sectional view of an air blowing unit 27 in the apparatus of FIG. 2.

A stop station $P_2$ subsequent to the processing station $P_1$ of the above-described rotary table 1 has arranged thereat blowing nozzles 25 and 25 for blowing clean air against the object W having the processing completed, to remove, from the object W, dust such as the abrasive grains adhering thereto. The blowing nozzles 25 and 25, the injection nozzles 3 and 4, the jet nozzle 5 and the suction unit 14 are covered by a cover 26, as shown in FIG. 5, which cooperates with an approximate half of the rotary table 1 to form a single, large processing chamber, so that the dust generated by these components is prevented from scattering to the outside, but is drawn into the dust collecting device 16. As shown in FIGS. 5 and 6, an air blowing unit 27 is provided, at a feeding-in side of the cover 26 at which the object W having not yet been processed is fed thereinto, for forming an air-curtain at the feeding-in side, and brushes 28 are provided at a feeding-out side thereof for the object W having been processed, so that the object W is freely capable of being fed in and out of the interior of the cover 26, and the interior and exterior of the cover 26 are shielded from each other.

In the above-described arrangement, the motors 1*a* and 11, valves 20 to 23, 29 and 30 are controlled by a controller 40.

A processing method of the object by means of the sandblasting carried out by the above-described processing apparatus will now be described.

The object W which is a subject of the processing is loaded on the holder 2 at a station P of the rotary table 1, and is transferred to the processing station $P_1$ by the intermittent rotation of the rotary table 1. As one object W stops at the processing station $P_1$, the motor 11 is actuated to first cause the injection nozzle 3 to move toward one of the surfaces to be processed $f_1$. As the injection nozzle 3 reaches a predetermined injection position, the air is discharged from the jet nozzle 5 toward the surface not to be processed $f_2$ of the object W, simultaneously therewith, the valves 20 and 21 associated with the injection nozzle 3 are opened, the valve 23 in the bypass tube 24 is closed, and the abrasive grains recirculated through a passage comprised of the tank 7, pipe 8, bypass tube 23, pipe 15, dust collecting device 16 and communication duct 19 are injected from the injection nozzle 3 toward the surface to be processed $f_1$ through the pipe 9 to process the surface. That is, the flash removal and the chamfering take place on the edges Wa and Wc at the side of the surface to be processed $f_1$. In this case, the air from the jet nozzle 5 is injected at a velocity (pressure) higher than that of the abrasive grains, so that after the impingement of the air against the surface not to be processed $f_2$, the air flows along the surface not to be processed $f_2$, to prevent the abrasive grains injected from the injection nozzle 3 from being brought into contact with the surface not to be processed $f_2$.

When the processing of one of the surfaces to be processed $f_1$ has been completed in this manner, the valve 21 is closed and the valve 23 is opened so that the abrasive grains are recirculated as described above, and the motor 11 is actuated to move the injection nozzle 3 away from the surface to be processed $f_1$ on which the processing has been completed, and to move the other injection nozzle 4 toward the surface to be processed $f_1$ which has not yet been processed. As this has been completed, the valve 29 associated with the injection nozzle 4 is opened, and the valve 23 is closed, so that the abrasive grains are injected from the injection nozzle 4 to process the surface to be processed $f_1$ which has not yet been processed. As the processing of the two surfaces to be processed $f_1$ of one object W has been completed, the rotary table 1 is rotated so that a new object W attached at the station P is transferred to the processing station P1, and the object W on which the processing has been completed is transferred to the subsequent station $P_2$. At the station $P_2$, the blowing nozzles 25 and 25 are actuated to blow the air against the processed object W to clean the same, and in this case, all of the air and the abrasive grains discharged within the cover 26 until now, together with the dust are collected into the dust collecting device 16 through the suction unit 14. The abrasive grains thus drawn into the dust collecting device 16 are separated from the dust and are returned to the tank 7 through the communication duct 19 for re-use in the processing.

The processed object W from which the dust and abrasive grains are removed at the station $P_2$ and which is fed out of the cover 26 is removed from the holder 2 at a station $P_3$.

The illustrated processing apparatus utilized for the description of the present invention is merely an example, and does not limit the processing method of the present invention.

Reference items when the present invention is carried out will be enumerated below.

(1) The jet nozzle 5 is normally disposed such that the exclusion fluid impinges against the surface not to be processed $f_2$ perpendicularly thereto, but it is possible to cause the exclusion fluid to obliquely impinge against the surface not to be processed $f_2$ to exclude the abrasive grains.

(2) The abrasive grain exclusion performance of the exclusion fluid jetted from the jet nozzle 5 has intimate relation to the velocity, specific gravity, particle size and the like of the abrasive grains injected from the injection nozzles 3 and 4.

(3) Although air is mainly utilized as the exclusion fluid jetted from the jet nozzle 5, it is possible to utilize liquid such as water.

As described above, in the present invention, since the abrasive grains are caused to impinge against the surface to be processed located adjacent the surface not to be processed, while the exclusion fluid is blown against the surface not to be processed, to avoid the impingement of the abrasive grains against the surface which has not to be processed, by the exclusion fluid to perform the processing, it is possible to process only the surface to be processed by the sandblasting, without damage due.to the abrasive grains on the surface which has not to be processed. In addition, since it is sufficient only to provide a jetting system of the exclusion fluid which is similar in fluid jetting function to the sandblasting, there is also provided an advantage that the processing apparatus is simple in structure.

Industrial Applicability

This invention is very useful for use in a processing where a chamfering takes place on a relatively small workpiece having a surface to be processed and a surface not to be processed which are located adjacent to each other, as is the case with a head for a video tape recorder, for example.

What is claimed is:

1. An apparatus for sandblasting a workpiece having a first portion not to be processed and a second portion to be processed, comprising:

(a) holding means for holding said workpiece in said prescribed processing station;

(b) fluid blowing means for blowing a pressurized fluid against said workpiece, said fluid blowing means including at least one nozzle disposed in said processing station for directing the pressurized fluid to said first portion of said workpiece;

(c) abrasive grain blowing means for causing abrasive grains to impinge against said workpiece to thereby sandblast said workpiece, said abrasive grain blowing means including abrasive grain supply means for supplying the abrasive grains carried on a carrying fluid, at least another nozzle disposed in said processing station, a first abrasive grain path means connecting said at least another nozzle with said abrasive grain supply means for directing the abrasive grains supplied from said abrasive grain supply means to said second portion of said workpiece, and a first valve mounted on said first abrasive grain path means for opening and closing said first abrasive grain path means for opening and closing said first abrasive grain path means;

(d) suction means for collecting the abrasive grains blown against said workpiece, said suction means comprising vacuum generating means, a suction port disposed in said processing station, a second abrasive grain path means connecting said suction port to said vacuum generating means for drawing said blown abrasive grains thereinto, and collecting means disposed between said suction port and said vacuum generating means for collecting said drawn abrasive grains to recirculate the abrasive grains into said abrasive grain supply means;

(e) fluidizing means for keeping said abrasive grains flowing when the processing of the workpiece is interrupted, said fluidizing means comprising a bypass passage connecting and second abrasive grain path to a portion of said first abrasive grain path located upstream from said first valve and a second valve mounted on said bypass passage; and (f) control means for operating said abrasive grain blowing means and said fluid blowing means concurrently, to thereby prevent the abrasive grains from impinging against said first portion and to cause the abrasive grains to impinge against only said second portion of said workpiece, said control means being operable to open said first valve and close said second valve when the workpiece is processed and to close said first valve and open said second valve to thereby cause said abrasive grains to be circulated through said bypass passage when the workpiece is not processed.

2. A processing apparatus according to claim 1, in which said workpiece has a pair of the second portions spaced from each other, said abrasive grain blowing means comprising a slider disposed in said processing station for sliding movement along said workpiece and a pair of said another nozzles mounted on said slider and spaced from each other in a direction of sliding movement of said slider, said control means being operable to selectively move said slider between a first position wherein one of the second nozzles is directed to one of the second portions of the workpiece and a second position wherein the other of said pair of said another nozzles is directed to the other second portion of the workpiece.

3. A processing apparatus according to claim 2, in which said suction port is mounted on said slider.

4. A processing apparatus according to claim 1, in which said fluidizing means further includes a third valve mounted on a portion of said second abrasive grain path means located upstream from said bypass passage, said control means being operable to open said third value when the workpiece is processed and close said third valve when the processing is interrupted.

5. A processing apparatus according to claim 1, in which said holding means comprises a rotary circular table, a plurality of holders disposed on said rotary table in circumferentially equally spaced relation to one another for holding the workpieces, respectively, and drive means attahced to said rotary table for intermittently rotating said rotary table to thereby index one of the workpiece in said processing station to a clearing station which is spaced from said processing station circumferentially on said rotary table in a direction of rotation of the rotary table.

6. A processing apparatus according to claim 5, further comprising air blowing means disposed in said cleaning station for blowing air against said workpiece in said cleaning station to clean the workpiece.

7. A processing apparatus according to claim 6, further comprising a base on which said rotary table is mounted, and a cover disposed on said base so as to surround said processing and cleaning stations to prevent dust produced at the stations from scattering to the outside environment.

8. A processing apparatus according to claim 7, further comprising an air blowing unit provided at a feeding-in side of said cover through which the workpiece is fed into an interior of the cover, and brushing means provided at a feeding-out side of said cover for preventing dust adhering to the workpiece from escaping outside of the cover.

* * * * *